United States Patent [19]

Lee

[11] Patent Number: 4,982,520

[45] Date of Patent: Jan. 8, 1991

[54] SEMI-AUTOMATIC PISTOL MAGAZINE

[76] Inventor: Jong W. Lee, 221 S. Norton Ave., Los Angeles, Calif. 90004

[21] Appl. No.: 304,063

[22] Filed: Jan. 30, 1989

[51] Int. Cl.[5] ..... F41A 9/61

[52] U.S. Cl. ..... 42/49.01; 42/50; 42/72

[58] Field of Search ..... 42/7, 50, 71.02, 72

[56] References Cited

U.S. PATENT DOCUMENTS

| | | | |
|---|---|---|---|
| 122,182 | 12/1871 | Lee | 42/60 |
| 386,535 | 7/1888 | Graham | 42/39.5 |
| 696,539 | 4/1902 | Bennett | 42/60 |
| 964,419 | 7/1910 | Giusto et al. | 89/155 |
| 1,042,837 | 10/1912 | Tatarek | 42/50 |
| 1,308,665 | 7/1919 | Douglas | 42/7 |
| 2,114,311 | 4/1938 | Nomar | 42/49.01 |
| 2,147,208 | 2/1939 | Nolan | 42/50 |
| 2,311,497 | 2/1943 | VanHorn et al. | 42/50 |

*Primary Examiner*—Charles T. Jordan
*Assistant Examiner*—Rochelle Lieberman
*Attorney, Agent, or Firm*—Frank Frisenda, Jr.

[57] ABSTRACT

The present invention provides an improved semi-automatic pistol magainze. In one embodied form, the unique pistol magazine member comprises an apparatus on which one end is compatible with a conventional piston magazine receptacle and the other is contoured to wrap snugly around the back of the holder's hand. The inventive magazine thereby provides the holder with the advantages of both greater bullet storage capacity and also greater compactness of bullet storage space. Moreover, the magazine chamber hugs the hand within the inner periphery of its contour thus providing the holder with added support and stability of grip. Also, in its presently preferred form, the magazine has the advantage of a relatively centrally disposed center of gravity which is conducive to greater balance and therefore better aim.

9 Claims, 1 Drawing Sheet

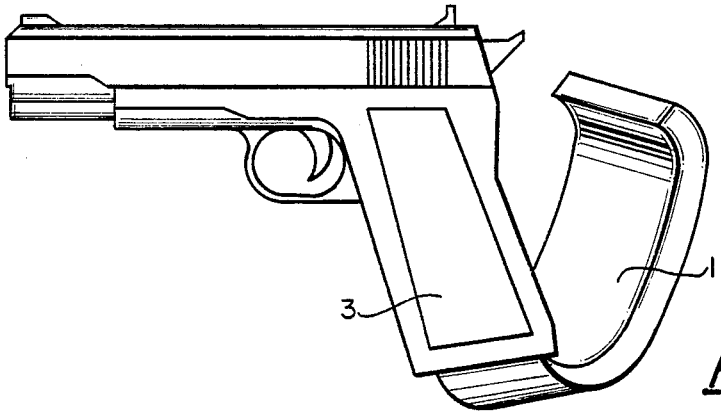
FIG. 1
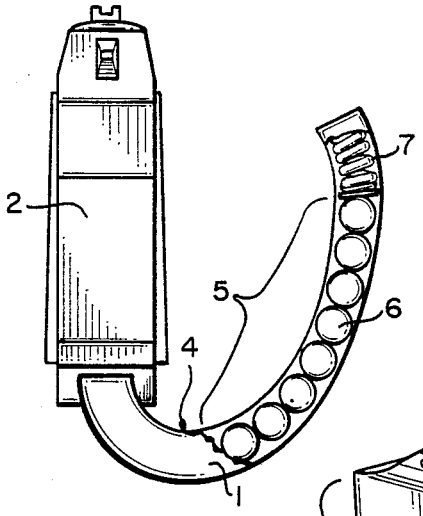
FIG. 2
FIG. 3
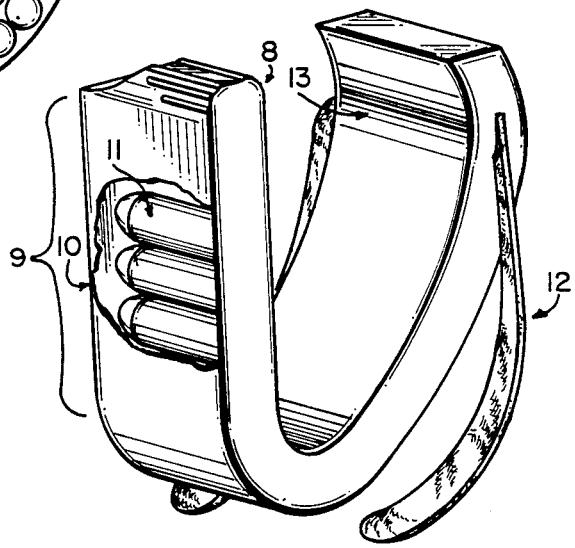

SEMI-AUTOMATIC PISTOL MAGAZINE

BACKGROUND OF THE INVENTION

1. Field of the Invention

The subject invention relates to the use of handguns, and more particularly to a semi-automatic pistol magazine In one embodied form, the disclosed invention comprises a pistol magazine which fits into the bottom of a pistol's hand-grip in a conventional manner and curves up and around the hand in a prescribed orientation so as to provide optimal storage capacity without reducing pistol manageability or balance.

2. Description of the Prior Art

Those skilled in the art have long recognized the importance of ammunition magazines. A magazine stores a number of bullets and sequentially feeds them into a firing position within the firearm. Usually, but not always, a magazine is designed as a cartridge into which the bullets are arranged sideways in a row. A tensile pressure is exerted upon the row by means of a spring which advances the array of bullets further as the empty cartridge of each fired bullet is discarded.

Various ammunition magazines have been described in the prior art that have allowed the possibility of improved ammunition magazine design.

U.S. Pat. No. 1,042,837 describes a pistol magazine which fits into the bottom of a pistol handle, as conventional magazines do, and protrudes from the bottom of the pistol grip in the form of a spiraling chamber. Bullets are sequentially pushed into firing position by means of the tensile force of a spring.

U.S. Pat. No. 122,182 describes a magazine that uses a spring to push bullets nose-first through a chamber which circumscribes the bottom surface of the pistol and curves up and around the back of the pistol.

U.S. Pat. No. 696,539 describes a design for a pistol and magazine combination in which the magazine cartridge slopes downward and feeds into the side of a revolver's barrel. The bullets slide along the declivity of the magazine's interior and drop directly into the barrel of the revolver which is specially designed to receive the bullets laterally through holes in the side of the barrel.

U.S. Pat. No. 964,419 describes a highly elaborate magazine design that transfers bullets nose-first by means of a conveyor belt which is actually built into the body of a firearm as a part of an integrated magazine-pistol system.

U.S. Pat. No. 1,308,665 describes a magazine for a pistol which is basically a very long flexible chamber that attaches to the belt of the wearer.

U.S. Pat. No. 2,147,208 describes a system of magazine design comprising a ring of separate magazines arranged around a turnstile. As each magazine is exhausted the turnstile is rotated to position a new magazine below the pistol's handle.

U.S. Pat. No. 386,535 describes a magazine design in which a chain of bullets is pulled from a spiral inside of a cylinder on the bottom of a firearm.

U.S. Pat. No. 2,114,311 describes a relatively complex set of machinery for a magazine extension that extends directly behind the handle of the firearm.

U.S. Pat. No. 226,560 relates to a method of making a magazine cartridge in which the magazine is curved presumably as a means of reducing much of the problem that would be associated with the long, straight magazine. However, this magazine is like the others in that it extends directly under and behind the pistol in a backward direction parallel to the pistol.

SUMMARY OF THE INVENTION

In accordance with the present invention, an improved semiautomatic pistol magazine which allows for the storage of a relatively large amount of ammunition and at the same time has a minimal degree of protrusion from a pistol assembly. Further, the inventive magazine is relatively simple in design and is therefore more reliable as a firearm accessory. Moreover the magazine, in its presently preferred form, is designed so as to improve the stability of a holder's grip.

More specifically the inventive magazine in one preferred embodiment comprises a rectangular cylinder designed to hold a plurality of bullets which are laterally disposed in a single layer within the magazine's interior. One end of the magazine is designed like a conventional pistol magazine in that it is a straight rectangular cylinder which is compatible with a conventional magazine receptacle in the hand-grip of a pistol. The other end of the magazine, in one preferred embodiment, is contoured in such a way that it curves upward near the point of emergence from the hand-grip and curves around the back of the holder's hand.

The bullets are pushed through the magazine's interior and into the firing position within the pistol's interior by means of a tensile force from a spring positioned within the end of the magazine's contoured portion. As each shot is fired the plurality of bullets is advanced one more position so that the next bullet is in position for firing.

In one preferred embodiment, the curvature of the magazine is contoured to create a snug fit around the back of the pistol holder's hand. The magazine may also be padded to create a tighter fit and reduce the impact from the kick of the pistol. Suitable fasteners of velcro or other type may be fastened to the body of the magazine for the purpose of fastening the pistol-magazine assembly to the hand and thus further enhancing grip stability.

In its presently preferred form the contour of the magazine comprises a shape and size that will ensure a relatively centralized center of gravity for the combined pistol-magazine combination. The contour of the magazine is designed so as to eliminate, as much as possible, any awkward protrusion from the pistol's structure.

BRIEF DESCRIPTION OF THE DRAWINGS

FIG. 1 is a side view of the semi-automatic pistol magazine in its presently preferred form as it is inserted into the pistol.

FIG. 2 is a rear view of the semi-automatic pistol magazine in its presently preferred form as it is inserted into the pistol.

FIG. 3 is a view of the semi-automatic pistol magazine in the abstract as it is constructed in its presently preferred embodiment.

DETAILED DESCRIPTION OF THE PREFERRED EMBODIMENTS

This invention provides a semi-automatic pistol magazine which optimizes efficient bullet storage capacity and provides a secure hand-grip for the user. Referring to FIG. 1, the pistol magazine 1 is designed to fit into a conventional magazine receptacle 2 in the bottom of the hand-grip of a pistol 3.

Referring to FIG. 2, the magazine's curved portion 4, in its presently preferred embodiment, is contoured to fit snugly around the hand of the holder. The cut-away portion 5 shows how the plurality of bullets 6, as they are disposed in their presently preferred embodiment, form a single layer of bullets arranged laterally with respect to each other. The cut-away portion of the drawing also reveals how the bullets in the preferred embodiment are pushed through the magazine by means of a tensile force from a spring 7.

Referring to FIG. 3, the magazine 8 is viewed in the abstract. The male end 9 of the pistol-magazine combination is basically the same as an ordinary ammunition magazine; it is a straight cylinder of rectangular width having the usual accommodations for fitting into a semi-automatic pistol. The cut-away portion 10 of the magazine's contoured portion reveals a plurality of bullets 11 as they are disposed in a single layer within the magazine's presently preferred embodiment. The picture also depicts how a strap 12 can be used in conjunction with the inventive device to further enhance the stability of the grip. The surface of the magazine 13, in one preferred embodiment, can also be padded with a foam-rubber type of material to further enhance the snugness of the grip.

I claim:

1. A semi-automatic pistol magazine comprising:

a cylinder for containing a plurality of bullets substantially aligned along longitudinal axes, in which one end of said cylinder fastens into the bottom of a pistol grip and the other end curves upwardly above the lower end of the pistol grip; and said cylinder being semi-helical in shape, having a distal leg and a proximal leg, said proximal leg having an outer peripheral portion which integrates with the internal portion of said pistol grip, said distal leg being upwardly curved above the lower end of the pistol grip.

2. A magazine as described in claim 1 that is designed so that it is compatible with a conventional pistol magazine receptacle.

3. A magazine as in claim 1 in which the inner periphery of the magazine's curvature hugs the back of a user's hand.

4. A magazine as in claim 1 in which the bullets are fed through the body of the magazine and into the pistol by means of a tensile force from a spring-like mechanism.

5. A pistol magazine as defined in claim 1 which is fastened tightly to a user's hand by means of a strap.

6. A pistol magazine as defined in claim 1 in which the magazine is padded with a foam material internally at the distal leg so that firmness and stability of grip are enhanced.

7. A semi-automatic pistol magazine comprising: a cylinder containing a plurality of bullets substantially aligned along longitudinal axes in which one end of said cylinder fastens into the bottom of a pistol grip and the other end curves upwardly above the lower end of the pistol grip; and a pistol magazine receptacle having a curvature which hugs the back of a user's hand.

8. A semi automatic pistol magazine as defined in claim 7 which is fastened tightly to a user's hand of the holder by means of a strap.

9. A pistol magazine as defined in claim 7 wherein the magazine is padded with a foam material internally at a distal leg so that firmness and stability of the grip is enhanced.

* * * * *